US006041435A

United States Patent [19]

Paulson et al.

[11] Patent Number: 6,041,435

[45] Date of Patent: Mar. 28, 2000

[54] DIELECTRIC HAT BRACKET FOR SAFETY HATS

[75] Inventors: Roy V. Paulson, Temecula; Donald R. Reiterman, Hemet, both of Calif.

[73] Assignee: Paulson Manufacturing Corporation, Temecula, Calif.

[21] Appl. No.: 09/023,402

[22] Filed: Feb. 12, 1998

[51] Int. Cl.[7] ..... A42B 3/22

[52] U.S. Cl. ..... 2/10; 2/424

[58] Field of Search ..... 2/10, 422, 424, 2/9, 209.13

[56] References Cited

U.S. PATENT DOCUMENTS

| | | | |
|---|---|---|---|
| 2,834,017 | 5/1958 | Simpson et al. | 2/10 |
| 4,364,123 | 12/1982 | Sam et al. | 2/209.1 |
| 4,928,324 | 5/1990 | Evans et al. | 2/424 |
| 5,546,610 | 8/1996 | Herzig et al. | 2/422 |

OTHER PUBLICATIONS

Checker Industrial Products, Inc., Goggle Retainer, 1 page.

*Primary Examiner*—Diana Oleksa
*Attorney, Agent, or Firm*—Baker & Maxham

[57] ABSTRACT

A dielectric face shield bracket that can be used to adjustably couple the face shield to a hard hat or cap. The invention is constructed solely of dielectric materials and, in one embodiment, comprises a two piece arcuately shaped frame where one piece of the frame hooks over the front brim portion of a full-brimmed hard hat and the other piece is coupled to a face shield. A flexible securing strap is coupled to the frame and extends over the crown of the hard hat, and the strap is used for securely holding the frame piece over the front of the brim portion. A pivot assembly is used in conjunction with the frame pieces to pivot one frame piece with respect to the other using a variable resistance pivot, thereby allowing the face shield to be easily locked at any position. In another embodiment, the flexible securing strap, amongst other elements, is eliminated and mounting brackets are substituted to allow the bracket to be adapted to a hard cap.

19 Claims, 4 Drawing Sheets

DIELECTRIC HAT BRACKET FOR SAFETY HATS

BACKGROUND OF THE INVENTION

1. Field of the Invention

This invention relates generally to a bracket for fitting a face shield to a safety hat, and more particularly, to a dielectric bracket fitted without tools to a safety hat potentially subjected to electric-arc exposure.

2. Discussion of the Prior Art

Face protection has become a necessity for individuals who work or play in the vicinity of hazardous conditions. Depending upon the conditions encountered, various designs for face protection have been proposed. The face protection previously known generally seeks to protect an individual's entire face against the hazardous conditions by using a face shield.

A face shield is usually worn in conjunction with a helmet, or safety cap or hat, collectively referred to as a "hard hat." Originally, attempts were made to fasten face shields directly to the hard hat. The results were marginal and such attachments were permanent in nature. Later, several methods of removeably coupling the face shield to the hard hat developed, such as snaps, clasps and various pin arrangements. Although these methods represented marked improvements, they resulted in the face shield being awkward to remove and rigidly fixed to the hard hat when in position to cover the wearer's face.

Improvements for coupling a face shield to a hard hat were realized by using a bracket, such as those disclosed in U.S. Pat. No. 3,797,041, entitled "Face Shield Bracket Mount for Helmets," and U.S. Pat. No. 4,928,324, entitled "Hard Hat Face Shield Bracket." These bracket designs allowed the face shield to be removeably fixed to a hard hat but movable away from a wearer's face while remaining attached to the hard hat, thereby permitting the face shield to be raised and lowered. The problem with these designs is that raising the face shield requires a fixed resistance to pivoting to be overcome, and the face shield can only be locked in the fully-raised position. This fixed resistance can cause the hard hat to shift, depending upon how well it fits the wearer's head. Moreover, locking only in the raised position prevents the face shield from being partially raised and locked, a desired feature, depending upon conditions under which the face shield is used. For example, additional ventilation under the face shield might be desired when working outdoors on a hot day although substantial face coverage is still required. Furthermore, the above-discussed brackets have traditionally been made from metal, inappropriate for use where electricity is likely to be encountered.

Although a great deal of attention has been focused on developing different face shields used with the brackets, little attention has been given to developing different brackets which are required in different conditions to maximize hard hat/face shield safety. To date, no bracket exists that is designed specifically for work conducted around high voltage power lines and related power transmission equipment. What is needed is a non-metallic (dielectric) bracket for adjustably mounting a face shield on a hard hat. Because full brim safety hats are becoming more popular for use in the power industry, what is specifically needed is a dielectric bracket used to adjustably mount a face shield to a full-brim safety hat.

SUMMARY OF THE INVENTION

Broadly speaking, the present invention is directed to an apparatus that satisfies the need for a dielectric bracket that can be used to adjustably couple a face shield to a hard hat.

The invention primarily comprises a two piece half-band frame where one piece of the frame hooks over the front brim portion of a full-brimmed hard hat and the other piece is coupled to a face shield, a simple securing strap coupled to the frame and extending over the crown of the hard hat wherein the strap is used for securely holding the frame piece over the front brim portion, and a pivot assembly used in conjunction with the frame pieces to pivot one frame piece with respect to the other using a variable resistance pivot, thereby allowing the face shield to be easily moved to, and locked at, any position. The present invention may be used even with very thin flexible face shields having minimum rigidity.

The securing strap in one embodiment may be a length of flexible tubing attached to the frame using a pair of swivel adapters. The swivel adapters are formed as round-nosed plastic rivets with a bend located near the rivet's head at one end of the rivet's elongated body. The adapter is pushed through a hole in the respective frame piece until the head strikes one side of the respective frame piece and the bent elongated body extends away from the opposite side of the frame piece. The flexible tubing is then slid over the rivet's elongated body. The firm rivet body is trapped within the hollow of the tubing so that when an attempt is made to pull the tubing from the rivet body, the tube tightens and seizes tightly to the body, thereby preventing separation. A second rivet is similarly positioned through the half-band frame piece opposite to the first rivet.

In this embodiment using flexible tubing, the tubing is stretched over the crown of the hard hat and rests between the rear of the crown and the brim at the rear of the hat. If a depression is molded into the hard hat at the intersection of the crown and the brim, the tubing preferably should lie in the depression. In this position, the tubing provides a secure coupling of the frame to the front brim of the hard hat.

In the preferred embodiment, the pivot assembly allows the face shield and the frame piece to which the face shield is mounted to pivot a minimum of 90° as the face shield is raised before it touches the crown of the hard hat. The shield may be attached to the frame with a system of toggles commonly used in the face shield industry. The pivot assembly may comprise a knob which screws into an opposing tee nut, thereby capturing a friction washer, O-ring, and frame pieces in a configuration which allows one frame piece to pivot with respect to the other. The configuration also allows locking in place and resistance to pivoting by the face shield, each of which may be controlled by the wearer of the bracket/face shield assembly.

BRIEF DESCRIPTION OF THE DRAWING

The objects, features, and advantages of the present invention will become better understood with regard to the following description and appended claims, when read in conjunction with the accompanying drawing, wherein:

DETAILED DESCRIPTION OF THE PREFERRED EMBODIMENTS

Figure 1:
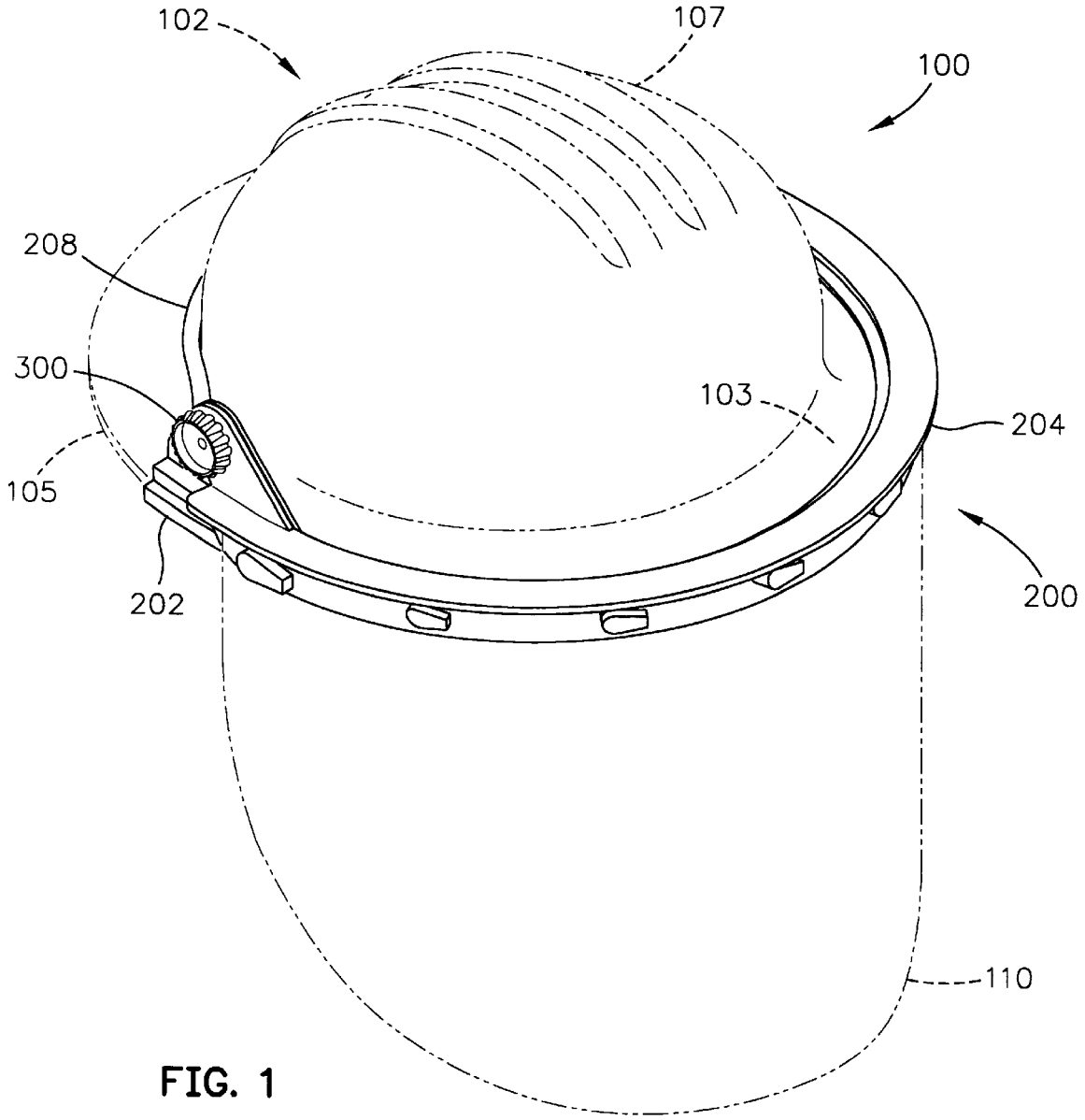
FIG. 1 is a perspective view of a safety hat with a bracket assembly and face shield constructed in accordance with one embodiment of the present invention.

With reference now to the drawing, and more particularly to FIG. 1 thereof, there is shown a perspective view of a preferred embodiment of an assembly 100 of a safety hat bracket apparatus 200 when coupled to a safety hat 102. Throughout the following detailed description, reference to a front part of safety hat 102 or any of its components generally refers to the side of safety hat 102 to which the safety hat bracket apparatus 200 is coupled, thereby allowing a face shield 110 to be placed immediately before the face of the wearer of the safety hat. Any reference to the rear of safety hat 102 refers to the opposite side of the hat.

Generally, the safety hat bracket assembly 200 in the preferred embodiment is made from a super-tough nylon such as Dupont Zytel (a trademark of Dupont) ST801 which possesses dielectric properties and strength while maintaining elevated temperature resistance. Alternatively, Amoco Amodel (a trademark of Amoco) material could be used, as could any material displaying similar characteristics, such as impact-modified high density polyethylene. The safety hat bracket assembly comprises an arcuately shaped elongated upper section 204 and a similarly shaped lower section 202 and either or both sections may be continuous or discontinuous. The arcuate shape may be sized to conform substantially with an arcuate shape of a front edge 103 of a hat brim 105 or may be more generally sized and/or shaped to allow fitting of the lower section 202 to a range of brim sizes and shapes. The lower section is preferably channel shaped and fashioned to receive the front brim edge 103 of the brim 105 of the safety hat 102. The channel-shape allows the front edge to be captured within the channel.

To assist in securely holding the lower section 202 and the front edge 103 together, the safety hat bracket apparatus 200 includes a retention strap 208. After the lower section 202 has been slid onto the front edge, the retention strap 208 is passed over a crown portion 107 of the safety hat and placed adjacent to the rearward intersection of the brim 105 and the crown portion 107. Upper section 204 of the bracket apparatus 200 includes pivot brackets located toward the ends of the upper section. The pivot brackets are pivotly coupled to mounting brackets positioned toward the ends of lower section 202 using a pivot assembly 300—shown in detail in FIG. 3—so that face shield 110 can be raised and lowered relative to the face of the safety hat wearer. That is, when lowered, the face shield 110 is positioned immediately in front of the safety hat wearer's face and when raised is positioned further away from and clear of the wearer's face. Although discussed relative to the safety hat 102, the hat bracket apparatus 200 could be coupled to a safety cap, such as safety cap 402 shown in FIG. 4A, using the lower section 202 and the retention strap 208 in a similar fashion.

Figure 2A:
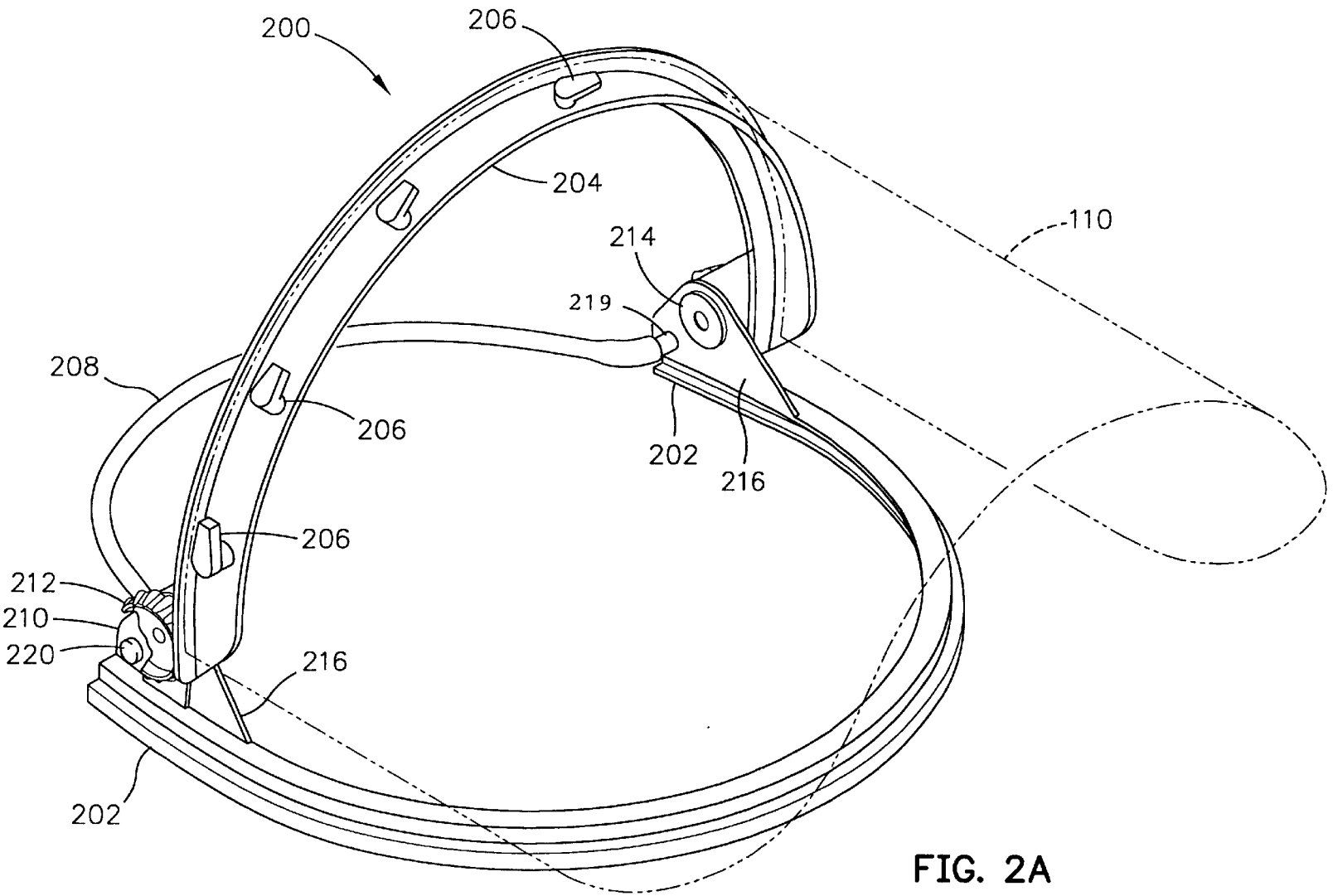
FIG. 2A depicts a perspective view of the bracket assembly of FIG. 1.

FIG. 2A shows the safety hat bracket apparatus 200 of FIG. 1 in greater detail. The upper section 204 in one embodiment may have a T-shaped cross section, where the horizontal top of the "T" is hereafter referred to as the T-crown and the vertical body is hereafter referred to as the T-body. Multiple fasteners 206 may be coupled to one side of the T-body as shown in FIG. 2A to provide a way to removeably attach a face shield to the upper section. The fasteners may be attached to the T-body in any fashion which allows rotation of the fasteners. For example, the fasteners may be riveted, screwed, pinned or otherwise attached. This allows each fastener to be passed through a respective hole in a face shield being mounted to the upper section 204 and, once through the hole, to be rotated, thereby trapping a section of the face shield between a fastener and the upper section. This "trapping" securely couples the face shield to the upper section. Although a rotational fastener such as discussed is preferred, it is not intended to limit the type of fastener that can be used. For example, snaps, pins, clamps, used singularly or collectively, interlocking strips, adhesive, or a slide mount could readily be substituted.

The lower section 202 is preferably a U-shaped channel. However, other shapes such as square, L or V-shape, or round shape can be used. The channel may be tightly sized to fit a specific brim of a safety hat, or as in the preferred embodiment, it may be sized to receive virtually any sized brim. Also, because the bracket assembly 200 is preferably constructed of a flexible material, variable brim sizes are readily accommodated. Regardless of how it is sized, the lower section 202 is slid over the forward most portion or edge of the brim when properly positioned on a safety hat 102. The lower section is securely held to the brim by the securing strap 208, preferably tubular in shape, coupled to the lower section by adapters 219. The securing strap is preferably made from a neoprene tube, such as that manufactured by SAS Rubber in Painesville, Ohio. The securing strap is stretched over the crown of the safety hat after the lower section is mounted as described above. Although slide mounting as discussed is preferred, the lower section 202 may be, for example, L-shaped and provided with the non-permanent fasteners mentioned above to secure it to the brim of the safety hat 102.

Figure 2B:
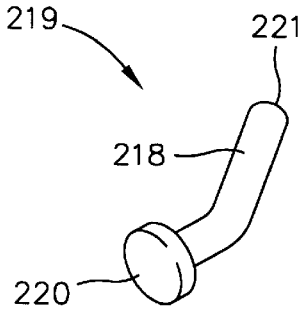
FIG. 2B is a perspective view of an adapter used in FIG. 1.

An adapter 219 used to couple the securing strap 208 to the lower section 202 is shown in greater detail in FIG. 2B. The adapter has an elongated body 218 including a head 220 at one end and a rounded end 221. The body 218 has a bend preferably located toward the head 220 and is cylindrical in shape. The head 220 is similar in shape to the head of a common nail, such as the type used to attach two pieces of wood together. The diameter of the cylindrical shaped body 218 is sized equal to or slightly larger than the inside diameter of the preferred embodiment tubular strap 208.

Figure 3:
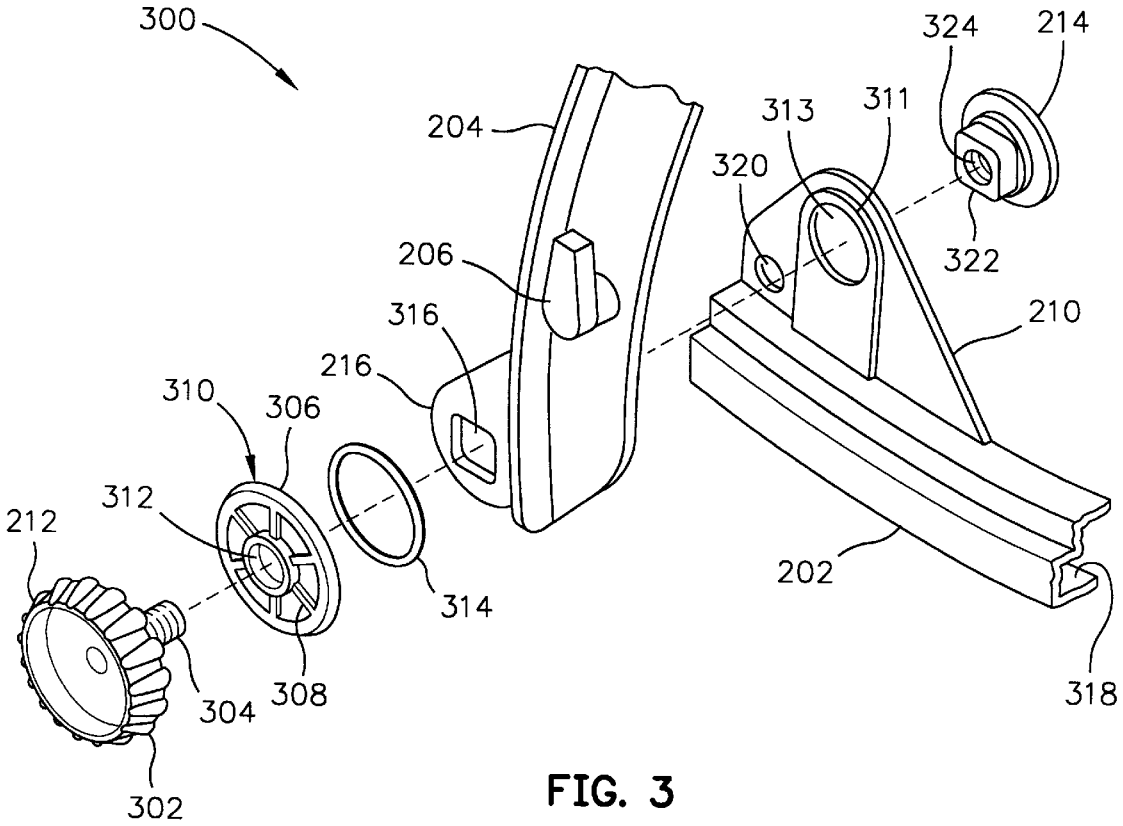
FIG. 3 shows an exploded perspective view assembly diagram of the pivot assembly of FIG. 2 and constructed in accordance with the present invention.

To couple the securing strap 208 to the lower section 202, adapter 219 is passed through a hole 320 located toward one end of lower section 202 in mounting bracket 210, the hole and bracket being shown in FIG. 3. End 221 of the adapter is passed through the hole 320, followed by the body 218, until the head 220 is juxtaposed to lower section 202. Once positioned, one end of the strap 208 is slid over the end 221 onto the body 218 of the adapter. This procedure is repeated in the preferred embodiment toward the other end of lower section 202, completing the coupling. Preferably, the hole 320 through which the adapter 219 is passed is sized slightly larger than the diameter of the body 218. This allows the adapters to be rotated if desired. A small amount of liquid adhesive may be placed on each adapter 219 prior to sliding the securing strap 208 over the adapters. The adhesive is used as a lubricant to assist in assembling the pieces and further secures the strap 208 to each adapter 219 when cured.

Upper section 204 also includes, in the preferred embodiment, pivot brackets 216, one each of which is located toward each end of the upper section. Lower section 202 includes mounting brackets 210, one each of which is located toward each end of the lower section. When safety hat bracket apparatus 200 is assembled, mounting brackets 210 and pivot brackets 216 are juxtaposed and cooperate with pivot assembly 300 to allow upper section 204 to pivot with respect to lower section 202.

As shown in FIG. 3, mounting bracket 210 may include a raised boss 311 that further assists in providing rotation between the pivot bracket 216 and the mounting bracket 210. Furthermore, pivot bracket 216, as shown, includes a non-round hole 316 used to receive a non-round protrusion 322 of a female-threaded fastener retention unit 214. Although a square hole is shown, the hole may be of any non-rounded configuration which acts to prevent rotation of the retention unit 214 when received. To provide resistance to the rotation of upper section 204 with respect to lower section 202, that is, when the face shield is raised or lowered, a male-threaded fastener 212 is used in the preferred embodiment in conjunction with the retention unit 214 to variably bind pivot bracket 216 with the raised boss 311 of mounting bracket 210. The degree of resistance is controlled by twisting the threaded fastener 212 about its longitudinal axis. A knob 302 is included in threaded fastener 212 to allow twisting to be done by hand.

When assembled, female-threaded fastener retention unit 214 is placed through a hole 313 in pivot mount 210. The hole 313 is sized slightly larger than the non-round protuberance extending from the retention unit 214 so that the retention unit can turn freely within the hole 313. The upper section 204 is placed adjacent to the lower section 202 and contacts the raised boss 311. The non-rounded hole 316 receives the non-rounded protrusion 322 to prevent rotation of the retention unit 214 with respect to pivot bracket 216. A thrust washer 306, preferably molded in GTX820, a 20% glass-filled nylon-noryl alloy manufactured by General Electric, and which entraps an O-ring 314, is positioned adjacent to the pivot bracket 216. A groove in the washer captures the O-ring and retains it so that the O-ring continues to perform its function, even if the O-ring deteriorates and breaks into sections, such as could be caused by ozone deterioration of the washer material. The washer may also be constructed of plastic rubber, or similar types of dielectric materials. The thrust washer 306 may partially or fully contact the protrusion 322 of the retention unit 214 although preferably the face of the protrusion 322 is substantially flush with the side of pivot bracket 216 which faces the thrust washer 306.

Furthermore, the thrust washer 306 has a thrust hole 312 about which the O-ring 314 is centered and through which the male threads of the threaded fastener 212 extend. The male threads 304, after passing through the thrust hole 312 and the O-ring 314, engage the female threads 324 of the retention unit 214. By twisting the threaded fastener 212, the upper section 204 is pulled closer and in tighter contact with the lower section 202. That is, binding between the pivot bracket 216 of the upper section 204 and the O-ring 314, and binding between thrust washer 306 and the knob 302, is increased or decreased depending upon whether the male threads of the threaded fastener further engage or disengage the female threads of the retention unit 214.

By varying the resistance to rotation in this manner, the wearer of the safety hat 102 may adjust the amount of resistance to be overcome in raising and lowering face shield 110. By further twisting the threaded fastener 212 to increase binding, the wearer of the safety hat may lock the face shield in any position desired. That is, the face shield 110 may be locked in a position so that the face shield fully covers the wearer's face or the face shield may be locked in a position to partially cover the wearer's face. Furthermore, the variable resistance aspect of the pivot assembly 300 allows the resistance to pivoting to be adjusted depending upon a variety of factors. For example, a very thin and light weight face shield might distort or fracture if a high degree of resistance to pivoting were encountered. Likewise, a thicker or heavier face shield might not remain in a desired raised position if the resistance to pivoting were minimized.

Figure 4A:
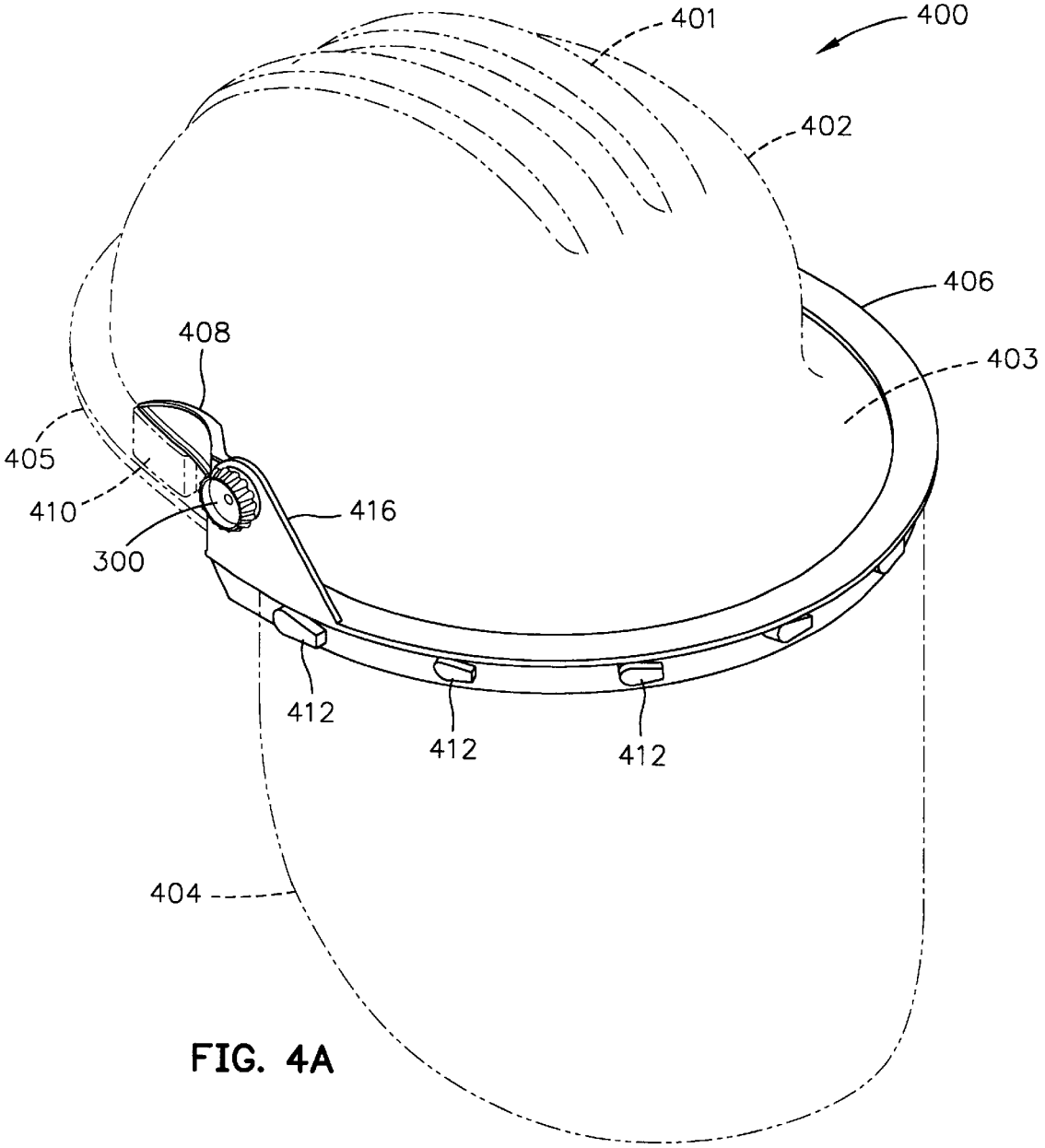
FIG. 4A is a side view of an embodiment of a safety hat with a bracket assembly and face shield in accordance with the present invention.

FIG. 4A shows another embodiment of the present invention. A cap bracket apparatus 400 is shown coupled to a safety cap 402 having a brim portion 403 extending from the front of the cap. The apparatus is preferably made of impact-molded high density polyethylene or, alternatively, ST801, or Amodel referenced above may be used. In this embodiment, an arcuately-shaped elongated frame 406 is used. The frame has a T-shaped cross section with the top of the T-shape being designated the crown and the body of the T-shape being designated the body. A face shield 404 attaches to the frame in a manner similar to that discussed above with relation to the safety hat bracket assembly 200. A multiplicity of clasps 412 are used to removably couple the face shield to the frame. The frame includes a mounting bracket 416, one of which is integral to each end of the frame 406. The mounting bracket cooperates with a hat bracket 408 to allow the frame to pivot with respect to the safety cap 402. That is, the face shield 404, when attached to the frame 406, may be placed in a position immediately before the face of a wearer of the safety cap, and, if desired, may be rotated to a position away from the face of the wearer. This rotation, or pivoting, is a result of the cooperation of the mounting bracket 416 and the hat bracket 408. As shown in FIG. 4A, two hat brackets 408, one shown and the other hidden by the cap, are preferably employed in the present invention. Alternatively, one hat bracket 408 may interact with one mounting bracket 416 to facilitate the pivoting of the face shield. As described above, a pivot assembly 300 is used in any case to pivotably couple a mounting bracket with a hat bracket.

Figure 4B:
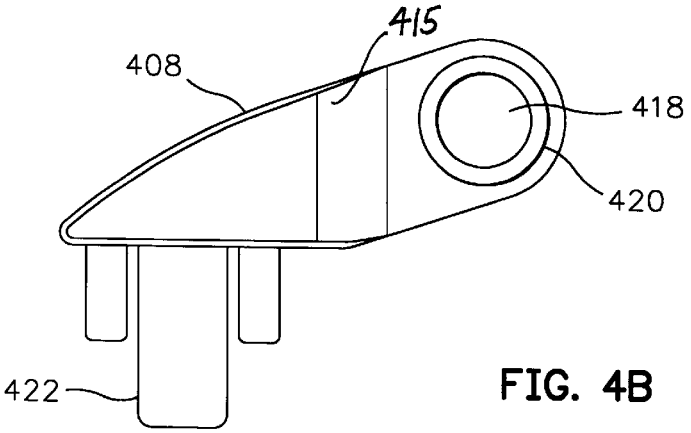
FIG. 4B is a side view of a mounting bracket used in conjunction with the bracket assembly shown in FIG. 4A.

The hat bracket 408 is detachably coupled to the safety cap 402 in the preferred embodiment by the use of a clip 422 shown in FIG. 4B which, when pressed into a channel 410 of the safety cap 402, securely holds the hat bracket to the safety cap. The clip 422 is a pressure clip assembly well known to those skilled in the fastening arts. The clip design used by the present invention allows the hat bracket 408 to be "unclipped" from the channel 410 so that the safety cap 402 may be separated from the cap bracket apparatus 400 if necessary. Alternatively, the pivot assembly 300 could be disassembled to facilitate removal from the frame 406 and the face shield 404 from the safety cap, thereby leaving the hat bracket 408 in place.

Similar to the mounting bracket 210 shown in FIG. 3, hat bracket 408 includes a hole 418 shown in FIG. 4B through which the pivot assembly 300 is assembled and cooperates in the pivoting of the frame 406. A raised boss 420 is also provided and contacts the mounting bracket 416 to facilitate pivoting of the frame 406. The hat bracket may also be provided in the preferred embodiment with an offset portion 415. The offset portion allows the channel 410 to be positioned immediately adjacent to a crown 401 and above a brim lip 405 of the safety cap 402. As shown in FIG. 4A, the rearward section of brim lip 405 is substantially narrower than the brim 403 of the safety cap. The brim lip 405 is contiguous with the brim 403 and extends around the crown 401.

In view of the specific foregoing description, ordinarily skilled artisans (having the benefit of this disclosure) will likely recognize that the apparatus discussed above may be implemented by using different yet similar construction, without departing from the scope of the invention. As a specific example, one of the hat brackets 408 in FIG. 4 may be eliminated and pivoting may be facilitated using only one pivot assembly 300. Furthermore, the hat bracket 408 may be differently sized to accommodate alternate locations for channel 410 of safety cap 402. The invention is to be limited only according to the spirit and scope of the accompanying claims.

What is claimed is:

1. A bracket for retaining a face shield in conjunction with a safety hat having a brim, said bracket comprising:

a dielectric flexible elongated upper section that, when viewed in cross-section, forms a T-shape, said upper section having a first end and a second end;

a flexible dielectric elongated channel-shaped lower section, said lower section having a first and a second end, said first end of said upper section being pivotably coupled to said first end of said lower section and said second end of said upper section being pivotably coupled to said second end of said lower section, thereby allowing said upper section to arcuately pivot with respect to said lower section, said channel-shaped lower section adapted to receive the brim of said safety hat;

at least one dielectric pivot apparatus for coupling said sections about their respective ends and allowing said face shield to be positioned at a location ranging from below the safety hat brim and in front of the wearer's face to above said safety hat brim and away from the wearer's face, each said dielectric pivot apparatus comprising:

a threaded fastener;

a thrust washer including a flexible O-ring; and a fastener retention unit, wherein said threaded fastener, thrust washer, and fastener retention unit are configured with respect to said upper and lower sections to allow pivoting with minimum resistance unless said threaded fastener is tightened, and if tightened, then to allow said sections to pivot with increasing resistance which is proportional to the tightening of the threaded fastener; and a retention strap coupled to said lower section and used to assist in coupling said lower section to said safety hat after said lower section has received said brim of said safety hat.

2. The bracket recited in claim 1, wherein each said thrust washer is a molded dielectric thermoplastic thrust washer including:

ribs to increase stiffness while providing a uniform wall thickness for optimum molding;

a hub which contacts said threaded fastener, said hub being sized to minimize friction caused by contacting said threaded fastener; and a groove, wherein each said O-ring is pressed into said groove and used to provide regulation of forces generated by tightening said threaded fastener, and wherein each said thrust washer isolates said O-ring from contact with said respective threaded fastener so that a desired loading can be achieved by tightening said threaded fastener by hand.

3. The bracket recited in claim 2, and further comprising dielectric adapters, wherein said retention strap is a flexible dielectric tube having ends coupled to said adapters, said tube being coupled to said adapters by sliding said flexible tube around said adapters, each said adapter comprising:

an elongated body having a distal end and a proximal end, said distal end being formed to receive an end of said flexible tubing;

a head formed at the extremity of said proximal end; and a bend in said body toward said proximal end;

wherein said adapter is coupled to said lower section, said coupling caused by pushing said distal end of said adapter through a hole formed in said lower section toward one end until said head proximally contacts said lower section and said distal end extends away from said lower section in a direction substantially away from said head.

4. The bracket recited in claim 3, and further comprising:

dielectric fasteners coupled to said dielectric T-shaped upper section for removeably attaching a transparent face shield to said upper section, wherein said face shield may be selectively positioned to cover the face of the wearer, said T-shaped section being adapted to form a lip over an upper portion of said face shield to prevent foreign materials from passing between said face shield and said upper section.

5. A bracket for retaining a face shield in conjunction with a safety hat having a brim, said bracket comprising:

a flexible dielectric elongated upper section having a first end and a second end;

a flexible dielectric elongated lower section, said lower section having a first end and a second end, said first end of said upper section being pivotably coupled to said first end of said lower section and said second end of said upper section being pivotably coupled to said second end of said lower section, thereby allowing said upper section to pivot with respect to said lower section, said lower section being adapted to receive said brim of said safety hat;

at least one dielectric pivot means for coupling said upper and lower sections about their respective ends, wherein said pivot means is configured for selectively varying resistance to pivoting and wherein said pivot means allows said face shield to be moved against said resistance and to be positioned at a location selected by a wearer, and wherein said pivot means is configured with respect to said upper and lower sections for pivoting with a selected resistance until said resistance is increased;

a dielectric retention strap coupled to said lower section and used to assist in coupling said lower section to said safety hat after said lower section has received said brim of said safety hat; and at least one dielectric adapter, wherein said retention strap is a dielectric flexible tube having ends coupled to said adapters, said tube being coupled to said adapters by sliding said flexible tube around said adapters, each said adapter comprising:

an elongated body having a distal end and a proximal end, said distal end being formed to receive an end of the flexible tubing;

a head formed at the extremity of said proximal end; and a bend in said body toward said proximal end;

wherein said adapter is coupled to said lower section, said coupling caused by pushing said distal end of said adapter through a hole formed in said lower section toward one end until said head proximally contacts said lower section and said distal end extends away from said lower section in a direction substantially away from said head.

6. The bracket recited in claim 5, and further comprising:

dielectric fasteners coupled to said dielectric T-shaped upper section for removeably attaching a transparent face shield to said section, wherein said face shield may be selectively positioned to cover the face of the wearer, said T-shaped section being adapted to form a lip over an upper portion of said face shield to prevent foreign materials from passing between said face shield and said upper section.

7. A bracket for retaining a face shield to a variety of hats, each hat having a brim, the bracket comprising:

an upper element structured to retain the face shield;

a lower element rotationally coupled to the upper element, the lower element comprising a gripping section sufficiently flexible to conform to at least a portion of the brim of each hat, and structured to grip the brim of each hat; and at least one pivotable assembly pivotably coupling the upper element to the lower element.

8. The bracket according to claim 7, further including a flexible strap structured to securely retain the bracket to the hat.

9. The bracket according to claim 7, wherein the upper element has a substantially T-shaped cross-section.

10. The bracket according to claim 7, wherein the upper element has a plurality of substantially L-shaped rotatable pins for retaining the face shield.

11. The bracket according to claim 7, wherein the pivotable assembly is hand-operated and is structured to rotationally couple the upper and lower elements and configured to allow adjustment of a resistance to rotation of the upper element relative to the lower element, whereby no tools are required to adjust the pivotable assembly.

12. The bracket according to claim 7, wherein the bracket is dielectric.

13. A bracket for retaining a face shield to a variety of hats, each hat having a brim, the bracket comprising:

an upper element structured to retain the face shield;

a flexible lower element structured to conform to the edge of each hat brim; and at least one hand-operated pivotable assembly structured to rotationally couple the upper and lower elements and configured to allow adjustment of a resistance to rotation of the upper element relative to the lower element, whereby no tools are required to adjust the hand-operated pivotable assembly.

14. The bracket according to claim 13, further including a flexible strap structured to securely retain the bracket to the hat.

15. The bracket according to claim 13, wherein the flexible lower element comprises a gripping section sufficiently flexible to conform to at least a portion of the brim of each hat and structured to grip the brim of each hat.

16. The bracket according to claim 13, wherein the bracket is dielectric.

17. A bracket for retaining a face shield to a variety of hats, each hat having a brim, the bracket comprising:

an upper element structured to retain the face shield, the upper element having a substantially T-shaped cross-section;

a lower element rotationally coupled to the upper element, the lower element comprising a gripping section sufficiently flexible to conform to at least a portion of the brim of each hat, and structured to grip the brim of each hat;

at least one hand-operated pivotable assembly structured to rotationally couple the upper and lower elements and configured to allow adjustment of a resistance to rotation of the upper element relative to the lower element, whereby no tools are required to adjust the hand-operated pivotable assembly; and a flexible strap structured to securely retain the bracket to the hat.

18. The bracket according to claim 17, wherein the bracket is dielectric.

19. The bracket according to claim 17, wherein the upper element has a plurality of substantially L-shaped rotatable pins for retaining the face shield.

* * * * *